US006685112B1

(12) United States Patent
Hornby et al.

(10) Patent No.: US 6,685,112 B1
(45) Date of Patent: Feb. 3, 2004

(54) FUEL INJECTOR ARMATURE WITH A SPHERICAL VALVE SEAT

(75) Inventors: Michael J. Hornby, Williamsburg, VA (US); Michael P. Dallmeyer, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/492,143

(22) Filed: Jan. 27, 2000

Related U.S. Application Data

(63) Continuation-in-part of application No. 08/997,274, filed on Dec. 23, 1997, now Pat. No. 6,047,907.

(51) Int. Cl.[7] ..... F02M 51/00

(52) U.S. Cl. ..... 239/585.1; 239/533.2; 239/533.3; 239/533.9; 239/584; 239/585.4; 239/585.5; 239/600; 239/900

(58) Field of Search ..... 239/533.2, 533.3, 239/533.6, 533.9, 583, 584, 585.1, 585.2, 585.4, 585.5, 600, 900; 251/129.21; 29/890.143

(56) References Cited

U.S. PATENT DOCUMENTS

| | | | | |
|---|---|---|---|---|
| 3,567,135 A | | 3/1971 | Gebert | 239/585 |
| 4,342,427 A | | 8/1982 | Gray | 239/585 |
| 4,520,962 A | | 6/1985 | Momono et al. | 239/585 |
| 4,597,558 A | | 7/1986 | Hafner et al. | 251/129.15 |
| 4,662,567 A | | 5/1987 | Knapp | 239/585 |
| 4,875,658 A | | 10/1989 | Asai | |
| 4,915,350 A | | 4/1990 | Babitzka et al. | 251/129.15 |
| 4,944,486 A | * | 7/1990 | Babitzka | 251/129.21 |
| 4,946,107 A | * | 8/1990 | Hunt | 251/129.21 X |
| 4,984,744 A | | 1/1991 | Babitzka et al. | 239/585 |
| 4,991,557 A | | 2/1991 | DeGrace et al. | 123/470 |
| 5,038,738 A | | 8/1991 | Hafner et al. | 123/470 |
| 5,054,691 A | | 10/1991 | Huang et al. | 239/585 |
| 5,058,554 A | | 10/1991 | Takeda et al. | 123/456 |
| 5,076,499 A | | 12/1991 | Cranford | 239/585 |
| 5,127,585 A | | 7/1992 | Mesenich | 239/585.5 |
| 5,167,213 A | | 12/1992 | Bassler et al. | 123/470 |
| 5,190,221 A | * | 3/1993 | Reiter | 239/463 |
| 5,211,341 A | | 5/1993 | Wieczorek | 239/585.3 |
| 5,236,174 A | | 8/1993 | Vogt et al. | 251/129.21 |
| 5,275,341 A | * | 1/1994 | Romann et al. | 239/585.4 |

(List continued on next page.)

FOREIGN PATENT DOCUMENTS

| | | |
|---|---|---|
| DE | 199 14 711 | 11/1885 |
| EP | 0 781 917 | 7/1997 |
| WO | WO 95 16126 | 6/1885 |
| WO | WO 93 06359 | 4/1993 |
| WO | WO 98/05861 | 2/1998 |
| WO | WO 98 15733 | 4/1998 |
| WO | WO 99 66196 | 12/1999 |
| WO | WO 00/06893 | 2/2000 |

*Primary Examiner*—Robin O. Evans

(57) ABSTRACT

A fuel injector having a fuel inlet, a fuel outlet, and a fuel passageway extending along an axis between the fuel inlet and the fuel outlet. The fuel injector includes a body having an inlet portion, an outlet portion, and a neck portion disposed between the inlet portion and the outlet portion. An adjusting tube is disposed within the neck portion of the body. A spring is disposed within the neck portion of the body, the spring having an upstream end proximate to the adjusting tube and a downstream end opposite the upstream end. An armature having a lower portion is disposed within the neck portion of the body and displaceable along the axis relative to the body. The downstream end of the spring is disposed proximate to the armature, the spring applying a biasing force to the armature. A valve seal is substantially rigidly connected to the lower portion of the armature. The fuel injector includes a valve group subassembly that is connected to a coil group subassembly.

33 Claims, 7 Drawing Sheets

U.S. PATENT DOCUMENTS 5,289,627 A * 3/1994 Cerny et al. ..... 239/585.5 X
5,340,032 A 8/1994 Stegmaier et al. ..... 239/575
5,462,231 A 10/1995 Hall ..... 239/585.4
5,494,224 A 2/1996 Hall et al. ..... 239/585.5
5,494,225 A 2/1996 Nally et al. ..... 239/585.5
5,520,151 A 5/1996 Gras et al. ..... 123/470
5,544,816 A 8/1996 Nally et al. ..... 239/585.5
5,560,386 A * 10/1996 Reiter et al. ..... 251/129.15 X
5,566,920 A 10/1996 Romann et al. ..... 251/129.21
5,580,001 A 12/1996 Romann et al. ..... 239/585.4
5,692,723 A 12/1997 Baxter et al. ..... 251/129.21
5,718,387 A 2/1998 Awarzamani et al. .... 239/585.1
5,732,888 A 3/1998 Maier et al. ..... 239/585.1
5,755,386 A 5/1998 Lavan et al. ..... 239/585.4
5,758,826 A * 6/1998 Nines ..... 239/533.9 X
5,769,391 A 6/1998 Noller et al. ..... 259/129.1
5,769,965 A 6/1998 Liedtke et al. ..... 148/121
5,775,355 A 7/1998 Maier ..... 137/15
5,775,600 A 7/1998 Wildeson et al. ..... 239/585.4
5,875,975 A 3/1999 Reiter et al. ..... 239/585.1
5,901,688 A 5/1999 Balsdon et al. ..... 123/516
5,915,626 A 6/1999 Awarzamani et al. ..... 239/135
5,927,613 A 7/1999 Koyanagi et al. ..... 239/585.1
5,937,887 A 8/1999 Baxter et al. ..... 137/15
5,944,262 A 8/1999 Akutagawa et al. ..... 239/585.4
5,975,436 A 11/1999 Reiter et al. ..... 239/585.1
5,979,411 A 11/1999 Ricco ..... 123/469
5,979,866 A 11/1999 Baxter et al. ..... 251/129.21
5,996,227 A 12/1999 Reiter et al. ..... 29/888.45
5,996,910 A 12/1999 Takeda et al. ..... 239/585.1
5,996,911 A 12/1999 Gesk et al. ..... 239/585.1
6,003,790 A 12/1999 Fly ..... 239/533.9
6,012,655 A 1/2000 Maier ..... 239/585.4
6,019,128 A 2/2000 Reiter ..... 137/549
6,024,293 A 2/2000 Hall ..... 239/5
6,027,049 A 2/2000 Stier ..... 239/585.1
6,039,271 A 3/2000 Reiter ..... 239/585.4
6,039,272 A 3/2000 Ren et al. ..... 239/597
6,045,116 A 4/2000 Willke et al. ..... 251/129.21
6,047,907 A 4/2000 Hornby ..... 239/585.1
6,076,802 A 6/2000 Maier ..... 251/129.21
6,079,642 A 6/2000 Maier ..... 239/585.1
6,089,467 A 7/2000 Fochtman et al. ..... 239/5
6,089,475 A 7/2000 Reiter et al. ..... 239/585.1
6,186,472 B1 2/2001 Reiter ..... 251/129.21
6,201,461 B1 3/2001 Eichendorf et al. ..... 335/256
6,264,112 B1 7/2001 Landschoot et al. ..... 239/5
6,328,232 B1 12/2001 Haltiner, Jr. et al. .... 239/585.1
2001/0017327 A1 8/2001 Fochtman ..... 239/585.4

* cited by examiner

FUEL INJECTOR ARMATURE WITH A SPHERICAL VALVE SEAT

CROSS-REFERENCE TO RELATED APPLICATION

This application is a continuation-in-part of U.S. application Ser. No. 08/997,274, filed on Dec. 23, 1997, now U.S. Pat. No. 6,047,907, which is hereby incorporated by reference herein in its entirety.

BACKGROUND OF THE INVENTION

This invention relates to solenoid operated fuel injectors used to control the injection of fuel into an internal combustion engine.

It is known in the fuel injection art to utilize a spherical valve ball within a solenoid operated fuel injector to close a fuel passageway in the injector. In such injectors, it is common to fabricate a flat on the ball valve and use the ball in combination with a collar that provides an annular cradling surface for the ball. A spring disc interfaces with the ball and urges the ball into an open position. Fuel is communicated around an armature and through the spring disc to establish fuel flow when the ball is in an unseated position. The ball must be guided to center itself on a seat of the fuel passageway and the armature requires a surface to keep the ball at least proximately concentric within the axis within the radial confinement imposed on the ball by the tip end of the armature.

With such assemblies, the dynamic flow rate of the fuel is set through the spring rate and selecting the spring becomes critical. These injectors require a non-magnetic plug in the bottom of their armatures to reduce wear and have a coil that is contacted by the fuel.

SUMMARY OF THE INVENTION

According to the present invention, a fuel injector is divided into two subassemblies. Each of the subassemblies are individually put together, and then the subassemblies are fastened to assemble the fuel injector.

The present invention provides a fuel injector for use with an internal combustion engine. The fuel injector comprises a valve group subassembly and a coil group subassembly. The valve group subassembly includes a valve body extending along a longitudinal axis; a valve seat secured to the valve body, the valve seat defining an outlet opening through which fuel flows; an armature movable along the longitudinal axis with respect to the valve body; a valve ball fixed to the armature, the valve ball being moved between an open position wherein the valve ball is spaced from the valve seat such that fuel flow through the outlet opening is permitted and a closed position wherein the valve ball contiguously engages the valve seat such that fuel flow is prevented; and a first fastening feature. The coil group subassembly includes a solenoid coil operable to displace the armature with respect to the valve body; and a second fastening feature matingly engaging the first fastening feature on the valve group subassembly.

The present invention further provides a method of assembling a fuel injector for use with an internal combustion engine. The method comprises assembling a valve group subassembly including fixing a closure member to an armature; assembling a coil group subassembly; and fastening together cooperating fastening features on the valve group subassembly and the coil group subassembly.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
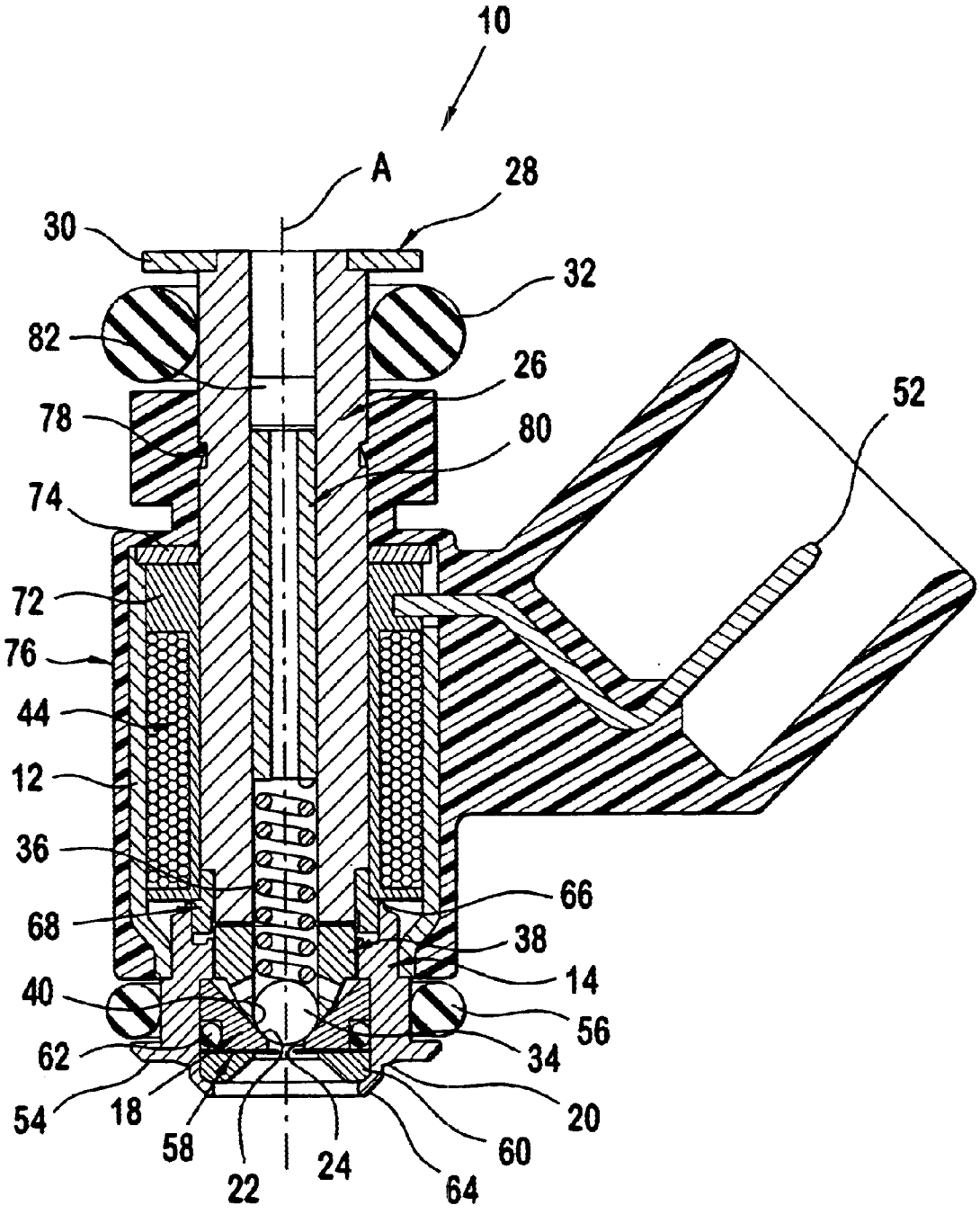
FIG. 1 is a cross-sectional view of a fuel injector assembly type according to a first embodiment of the present invention.
Figure 2:
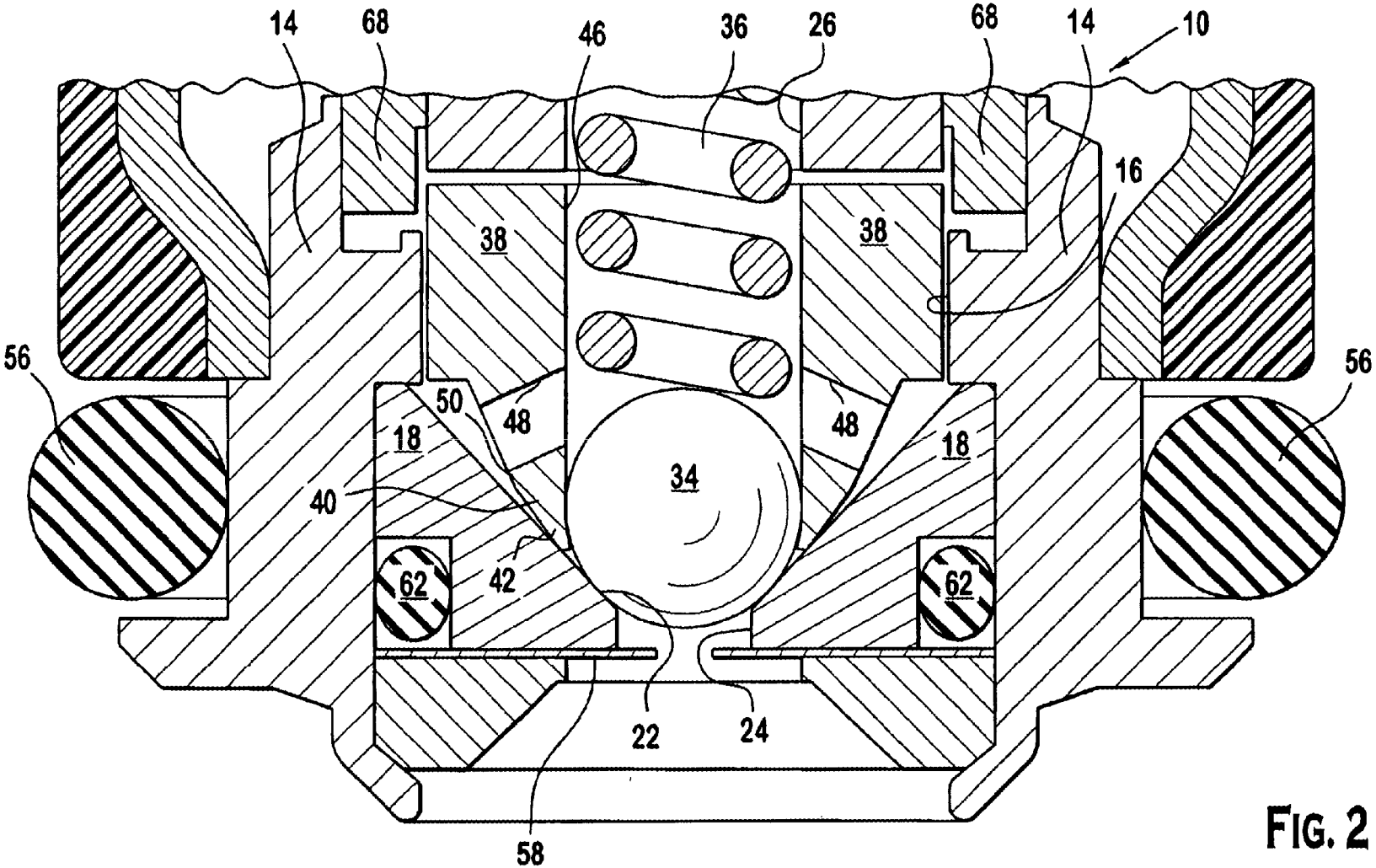
FIG. 2 is an enlarged cross-sectional view of the fuel injector assembly shown in FIG. 1 wherein a valve body subassembly is in a closed position such that a valve ball contiguously engages a seating surface.
Figure 3:
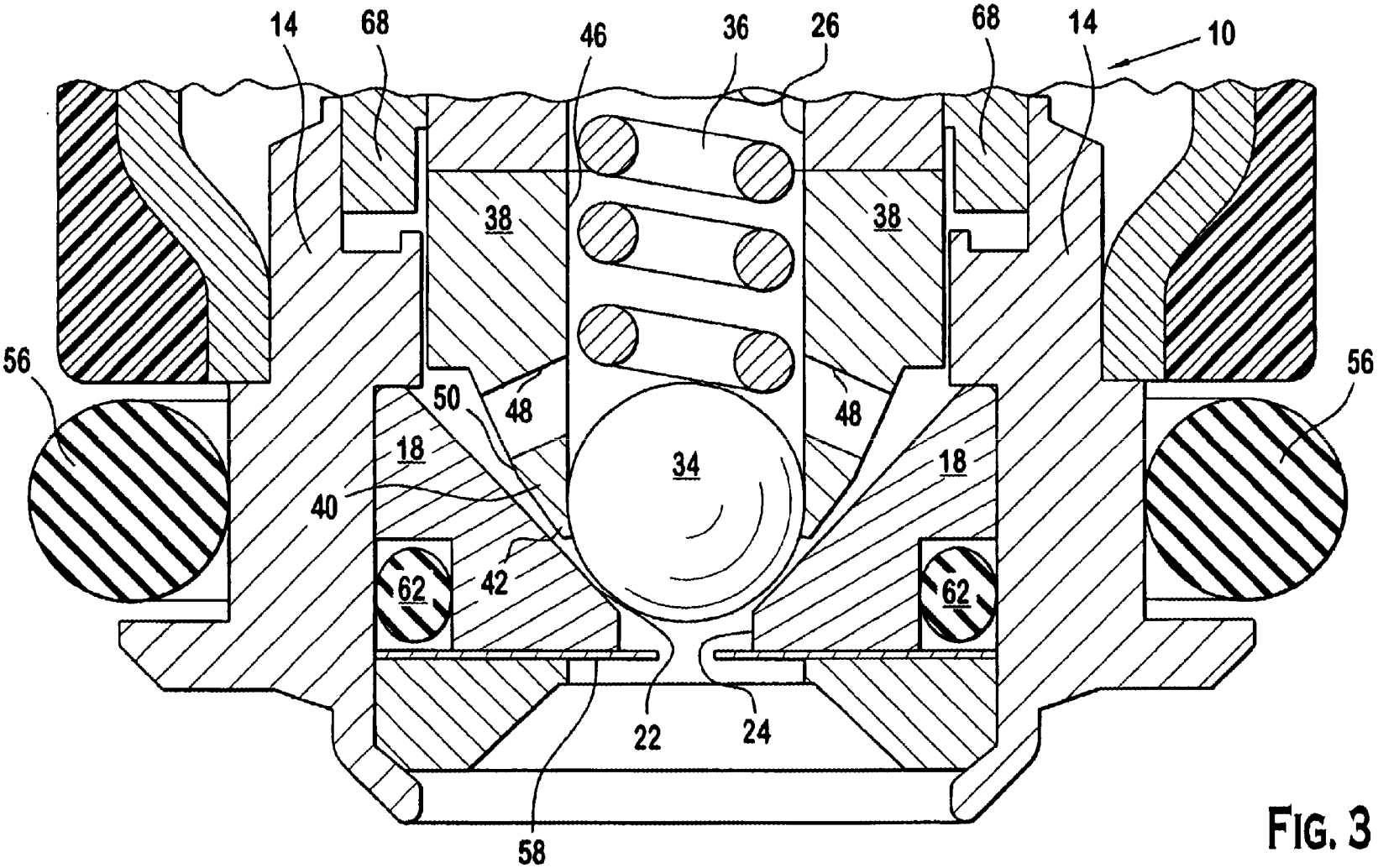
FIG. 3 is an enlarged cross-sectional view of the fuel injector assembly shown in FIG. 1 wherein the valve body subassembly is in an open position such that a valve ball is raised off the seating surface.

Referring initially to FIGS. 1–3, a solenoid actuated fuel injector 10, which can be of the so-called top feed type, supplies fuel to an internal combustion engine (not shown). The fuel injector 10 includes a housing 12 having a longitudinal axis A and a valve body 14 fixed to the housing 12. The valve body 14 has a cylindrical sidewall 16 coaxial with the housing longitudinal axis A that laterally bounds the interior of the valve body 14.

A valve seat 18 at one end 20 of the valve body 14 includes a seating surface 22, which can have a frustoconical or concave shape, facing the interior of the valve body. The seating surface 22 includes a fuel outlet opening 24 centered on the axis A and is in communication with an inlet connector or fuel tube 26 for conducting pressurized fuel into the valve body 14 against the seating surface 22. Fuel tube 26 includes a mounting end 28 having a retainer 30 for mounting the fuel injector 10 in a fuel rail (not shown) as is known. An O-ring 32 is used to seal the mounting end 28 in the fuel rail.

A closure member, e.g., a spherical valve ball 34, within the injector 10 is moveable between a seated, i.e., closed, position as shown in FIG. 2, and an open position as shown in FIG. 3. In the closed position, the ball 34 is urged against the seating surface 22 to close the outlet opening 24 against fuel flow. In the open position, the ball 34 is spaced from the seating surface 22 to allow fuel flow through the outlet opening 24. A spring 36 in valve body 14 biases the valve ball 34 toward the closed position.

An armature 38 that is axially moveable in the valve body 14 includes valve ball capturing means 40 at an end 42 proximate the seating surface 22. The valve ball capturing means 40 engages with the ball 34 outer surface adjacent the seating surface 22 and rests on the seating surface 22 in the closed position of the valve ball 34.

A solenoid coil 44 is operable to draw the armature 38 away from the seating surface 22, thereby moving the valve ball 34 to the open position and allowing fuel to pass through the fuel outlet opening 24. Deactivation of the solenoid coil 44 allows the spring 36 to return the valve ball 34 to the closed position against the seating surface 22 and to align itself in the closed position, thereby closing the outlet opening 24 against the passage of fuel.

The armature 38 includes an axially extending through-bore 46 that allows fuel to pass. Through-bore 46 also receives the valve ball 34 in a close tolerance fit yet allows the ball 34 to move freely in the through-bore 46 whereby the valve ball 34 is self aligning upon seating. A fuel passage 48 extends from the through-bore 46 to the outer surface 50 of the armature 38 that is juxtaposed to the seating surface 22, allowing fuel to be communicated around the valve ball 34.

The valve ball capturing means 40 engages the ball 34 at a diameter of the ball 34 that is less than the major diameter of the ball 34 and at a position between the major diameter of the ball 34 and the seating surface 22. Herein the valve ball capturing means 40 is a reduced diameter aperture having a diameter less than the major diameter of the valve ball 34 on the axially extending through-bore 46 in the armature 38 or a plurality of fingers extending from the armature 38.

With further reference to FIG. 1, an electrical connector housing 52, is provide for connecting, via a mating electrical connector housing 52*a*, to an electrical power supply 90 in order to power the armature 38. The valve body 14 includes a mounting end 54 for mounting the injector 10 in an intake manifold (not shown) as is known. An O-ring 56 is used to seal the mounting end 54 in the intake manifold. An orifice disk 58 may be provided proximate the outlet opening 24 for controlling the fuel communicated through the outlet opening 24. A back-up washer 60 is used to mount the orifice disk 58 in the valve body 14 and an O-ring 62 is mounted between valve body 14 and valve seat 18 adjacent the orifice disk 58. The injector 10 is made of two subassemblies that are each first assembled, then fastened together to form the injector 10. Accordingly, the injector 10 includes a valve group subassembly and a coil group subassembly as hereinafter more fully described.

In the valve group subassembly, the valve seat 18, O-ring 62, and backup washer 60 are loaded into the valve body 14, held in a desired position, and the end 64 of the valve body 14 is bent inwardly. The valve ball 34 is placed into the armature 38, and the armature 38 and valve ball 34 are assembled in the valve body 14. A measurement is taken between the top 66 of the valve body 14 and the top of the armature 38 with the armature 38 pulled up against the ball 34.

A non-magnetic sleeve 68 is pressed onto one end of the inlet connector 26 and the sleeve 68 and inlet connector 26 are welded together to provide a first hermetic joint therebetween. The sleeve 68 and inlet connector 26 are then pressed into the valve body 14, and the sleeve 68 and valve body 14 are welded together to provide a second hermetic joint therebetween completing the assembly of the valve group subassembly. These welds can be formed by a variety of techniques including laser welding, induction welding, spin welding, and resistance welding.

The coil group subassembly is constructed as follows. A plastic bobbin 72 is molded with straight terminals. Wire for the selenoid coil 44 is wound around the plastic bobbin 72 and the bobbin assembly is placed into a metal can which defines the housing 12. A metal plate that defines the housing cover 74, is pressed into the housing 12. The terminals are bent to their proper location. An over-mold 76 covering the housing 12, solenoid coil 44, and bobbin 72 completes the coil group subassembly.

The group subassembly is then pressed and fastened onto the inlet connector 26 and held together by a fastening feature 78 molded into the plastic over-mold 76. The upper O-ring retainer 30 is then installed and crimped into place on the inlet connector 26. The spring 36 and adjusting tube 80 are installed in the inlet connector 26 and the injector 10 is calibrated by adjusting the relative positioning of the adjusting tube 80 in the inlet connector 26 and crimping the adjusting tube 80 in place. A filter 82 is then mounted in the inlet connector 26.

Figure 4:
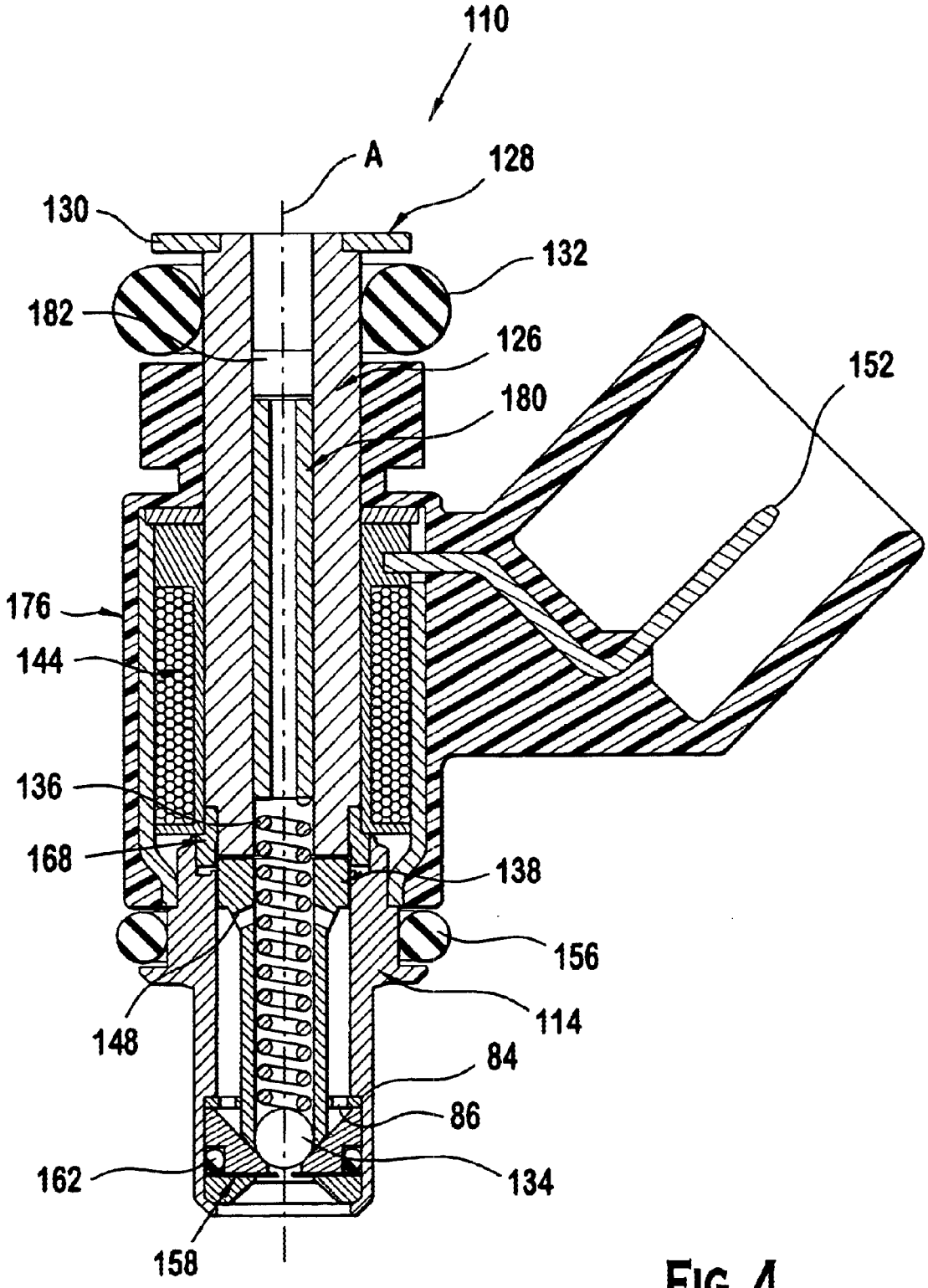
FIG. 4 is a cross-sectional view of a fuel injector assembly type according to a second embodiment of the present invention.

FIG. 4 illustrates an alternative injector 110 having an extended tip section. In the description of injector 110 which follows, similar structure as previously referenced in FIGS. 1–3 is indicated by similar reference characters. Injector 110 includes a guide and screen member 84 mounted in the valve body 114. Guide and screen member 84 includes a centered aperture 86 for receiving and guiding an armature 138 and to keep the armature 138 from moving off the longitudinal axis A during operation. Guide and screen member 86 includes openings, preferably slotted openings of a size smaller than the injector opening, to allow fuel to pass and trap stray particles larger than the openings in the guide and screen member 86.

Figure 5:
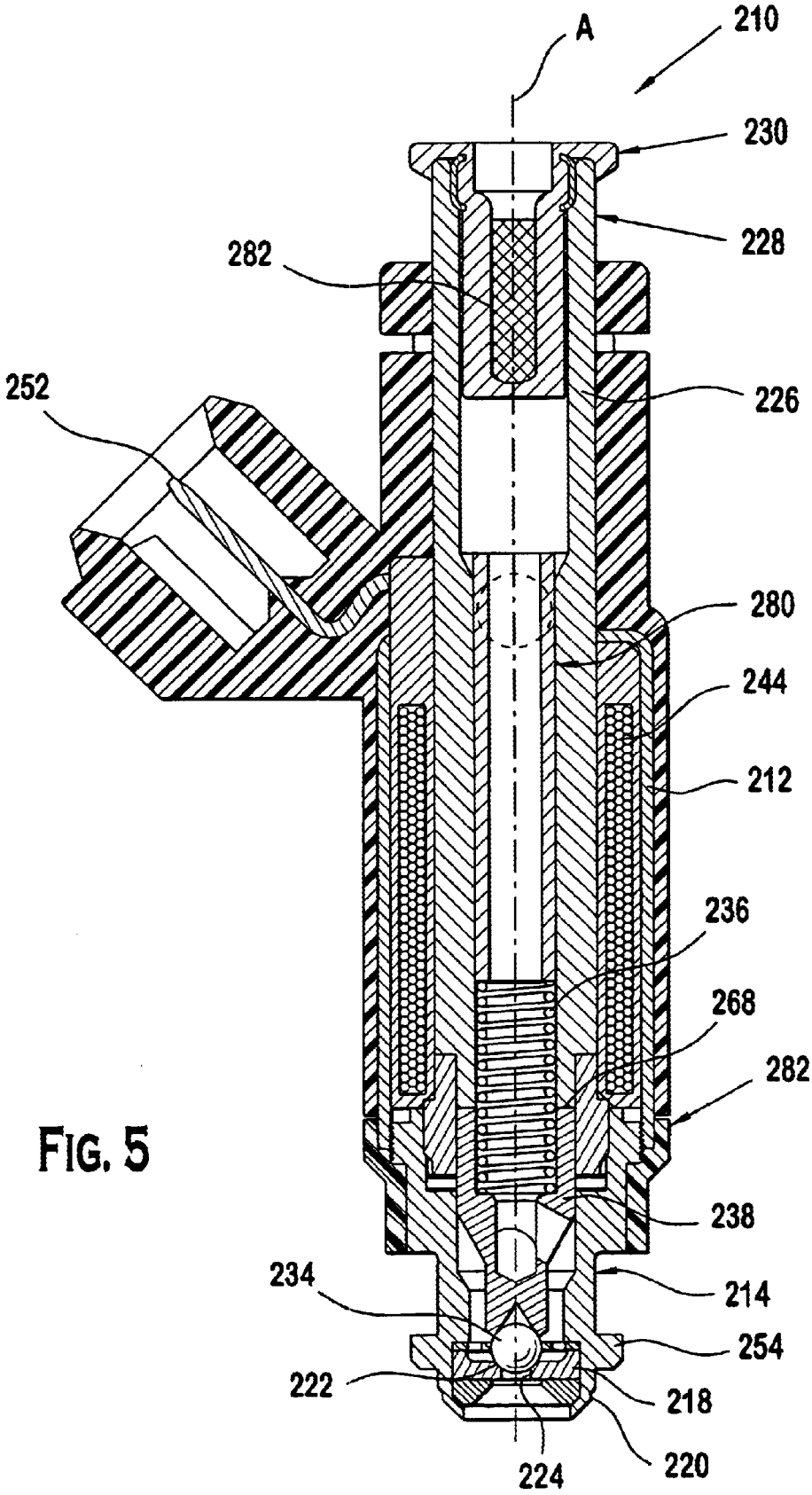
FIG. 5 shows a cross-sectional view of a fuel injector assembly according to a third embodiment of the present invention.
Figure 6:
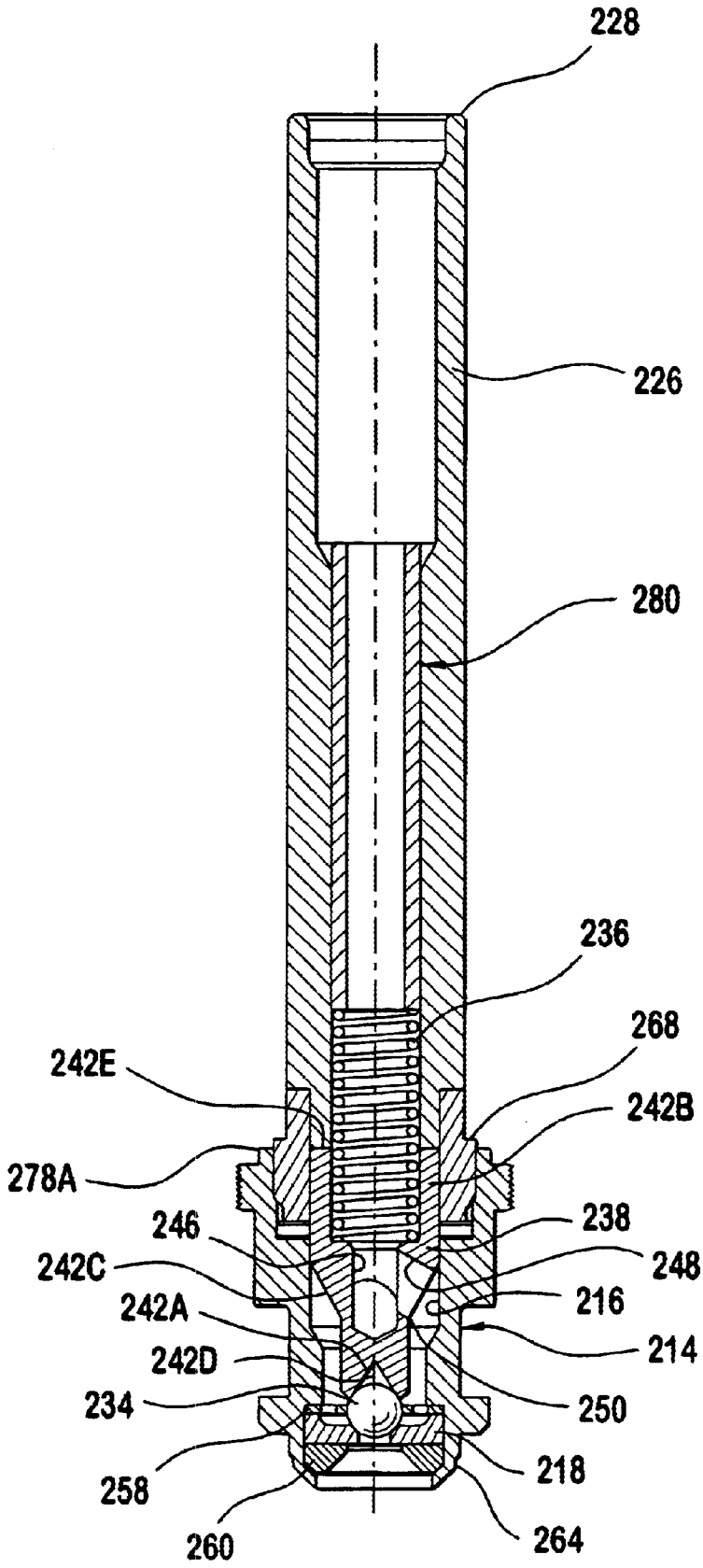
FIG. 6 shows a cross-sectional view of the valve group subassembly of fuel injector assembly shown in FIG. 5.
Figure 7:
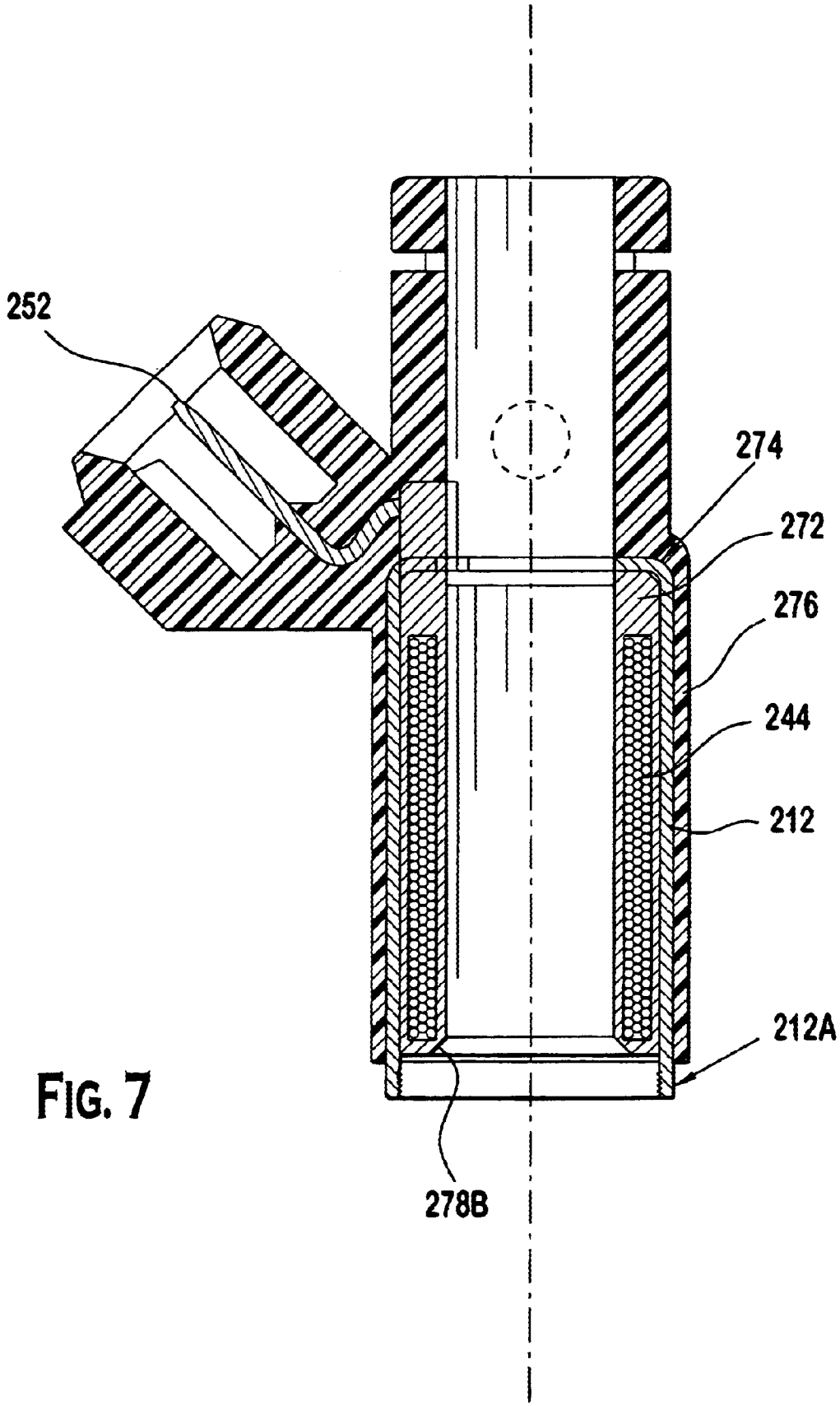
FIG. 7 shows a cross-sectional view of a coil group subassembly of the fuel injector assembly shown in FIG. 5.

Referring now to FIGS. 5–7, a fuel injector assembly 210, includes a housing 212 extending along a longitudinal axis A and a valve body 214 that is connected to the housing 212 via a fastening feature, as is more fully described below. The valve body 214 has a cylindrical sidewall 216 coaxial with the housing longitudinal axis A that laterally bounds the interior of the valve body 214.

A valve seat 218 at one end 220 of the valve body 214 includes a seating surface 222, which can have a frustoconical or concave shape, facing the interior of the valve body. The seating surface 222 includes a fuel outlet opening 224 centered on the axis A, and in communication with an inlet connector or fuel tube 226 for conducting pressurized fuel into the valve body 214 against the seating surface 222. Fuel tube 226 includes a mounting end 228 having a retainer 230 for mounting the fuel injector 210 in a fuel rail (not shown), as is known. The retainer 230 is used to seal the mounting end 228 in the fuel rail. The retainer 230 can also include a filter 282 for collecting debris passing from the fuel rail to the fuel injector 210.

A closure member, e.g., a spherical valve ball 234, within the injector 210 is moveable between a seated, i.e., closed, position and an open position. In the closed position, the ball 234 is urged against the seating surface 222 to close the outlet opening 224 against fuel flow. In the open position, the ball 234 is spaced from the seating surface 222 to allow fuel flow through the outlet opening 224. The valve ball 234 is at least a portion of a sphere, e.g., a gage ball or a ball bearing. An armature 238, which is axially moveable in the valve body 214, includes a downstream portion 242A, an upstream portion 242B, and an intermediate portion 242C between the downstream and upstream portions 242A, 242B. The downstream portion 242A, which is proximate the seating surface 222, provides a fixture for receiving the valve ball 234, centering the valve ball 234 with respect to the longitudinal axis A, and securing the valve ball 234 to the armature 238, e.g., by welding or other known fastening techniques. The downstream portion 242A can include a conical depression 242D for receiving and centering the valve ball 234. The upstream portion 242B can comprise a cylindrical depression 242E for cooperatively receiving a spring 236 and for receiving fuel flow from the fuel tube 226. The spring 236 provides a biasing force that urges the armature 238 toward the closed position. The intermediate portion 242C directs the flow of fuel from the interior of the armature 238, i.e., within the cylindrical depression 242E, to the exterior of the armature 238, i.e., over an outer surface 250 that is juxtaposed to the seating surface 222, thereby allowing fuel to be communicated around the valve ball 234. The intermediate portion 242C comprises an axially extending bore 246, which is connected to the cylindrical depression 242E, and at least one passage 248, which connects the bore 246 to the outer surface 250. The passage 248 can extend obliquely with respect to the longitudinal axis A. Alternatively, the passage can extend perpendicularly from the bore 246, i.e., radially with respect to the longitudinal axis A.

The lower end portion 242A can comprise any fixture that is capable of receiving the valve ball 234, centering the valve ball 234 with respect to the longitudinal axis A, and being secured to the valve ball 234. For example, the intermediate portion 242C can comprise a tubular cylinder such that the open end of the cylinder, i.e., the end that is opposite to the connection with the upstream portion 242B, can define the downstream portion 242A. The intermediate 242C can have the passages 248 that can extend radially with respect to the longitudinal axis A. Accordingly, the conical depression 242D is eliminated and the valve ball 234 is centered on the open end of the intermediate portion 242C.

A solenoid coil 244 is operable to draw the armature 238 away from the seating surface 222, thereby moving the valve ball 234 to the open position and allowing fuel to pass through the fuel outlet opening 224. Deactivation of the solenoid coil 244 allows the spring 236 to return the armature 238 to the closed position, i.e., with the valve ball 234 against the seating surface 222, thereby closing the outlet opening 224 against the passage of fuel.

An electrical connector housing is provided for connecting, via a mating electrical connector housing 252*a*, the armature 238 to an electrical power supply 290 in order to power the armature 238. The valve body 214 includes a mounting end 254 for mounting the injector 210 with an O-ring (not shown) in an intake manifold (not shown), as is known.

A guide disk 258 can be mounted upstream of the valve seat 218. The guide disk 258 has a plurality of fuel passage openings that regulate the supply of fuel communicated to the outlet opening 224. The guide disk 258 can be mounted with respect to the valve body 214 by laser welding or other known fastening techniques. Alternatively, a back-up washer 260 can be used to mount the valve seat 218 in the valve body 214.

The injector 210 is made of two subassemblies that are each first assembled, then fastened together to form the injector 210. Thus, the injector 210 includes a valve group subassembly, as shown in FIG. 6, and a coil group subassembly, as shown in FIG. 7.

The valve group subassembly includes the valve body 214, the valve seat 218, the fuel tube 226, the valve ball 234, the spring 236, the armature 238, and the back-up washer 260.

The valve group subassembly also includes, when it is used, the guide disk 258. The valve group subassembly further includes a sleeve 268 and a tube 280, which are described below.

The coil group subassembly includes the housing 212, the solenoid coil 244, and the electrical connector 252. The coil group subassembly further includes a bobbin 272, a cover 274, and an over-mold 276, which are described below.

The valve group subassembly can be constructed as follows. The valve seat 218, the backup washer 260, and the guide disk 258, if it is used, are loaded into the valve body 214, held in a desired position, and the end 264 of the valve body 214 is bent inwardly.

The depression 242D is formed in the lower end portion 242A of the armature 238 for receiving and centering the valve ball 234, which is fixed to the armature 238, e.g., by welding. Alternatively, if the intermediate portion 242C of the armature 238 comprises a tubular cylinder, the valve ball 234 can be received in, centered by, and fixed to the intermediate portion 242C so as to define the lower end portion 242A of the armature 238.

The armature 238 is positioned inside the valve body 212 such that the valve ball 234 confronts the seating surface 222. In the open position of the fuel injector 210, the valve ball 234 is spaced from the seating surface 222 so as to permit the passage of fuel through the outlet opening 224. In the closed position of the fuel injector 210, the valve ball 234 contiguously engages the seating surface 222 so as to prevent the passage of fuel through the outlet opening 224.

A non-magnetic sleeve 268 is fitted onto one end of the fuel tube 226. The sleeve 268 and the fuel tube 226 can be welded to provide a first hermetic joint. The sleeve 268 and fuel tube 226 are then fitted together with the valve body to provide a second hermetic joint. The sleeve 268 can be welded to the valve body 214. These welds can be formed by a variety of techniques including laser welding, induction welding, spin welding, and resistance welding.

The spring 236 and an adjusting tube 280 are installed inside the fuel tube 226, and the injector 210 is calibrated by adjusting the relative position of the adjusting tube 280 with respect to the fuel tube 226. The adjusting tube 280 can be fixed to the fuel tube 226 by crimping or other known fastening techniques.

The coil group subassembly can be constructed as follows. A plastic bobbin 272 is molded with straight terminals. Wire for the coil 244 is wound around the plastic bobbin 272 and electrically connected to the terminals. The coil 244 is then placed into a metal can which defines the housing 212. A metal plate that defines the housing cover 274 is fitted to the housing 212, and the terminals are bent to the shape of the electrical connector 252. A plastic over-mold 276 can be molded around the housing 212, solenoid coil 244, and bobbin 272 to complete the coil group subassembly. Additionally, as will be further discussed below, a portion 212A of the housing 212 can project beyond the over-mold 276.

The valve group subassembly is fitted inside the coil subassembly, and the two subassemblies are held together by a fastener feature. The fastener feature can include a first fastener member 278A formed on the valve body 214 and a cooperating fastener member 278B formed on the housing 212. The fastener feature can include welding, snap-fitting, or other known techniques for retaining a first element with respect to a second element. For example, the projecting portion 212A of the housing 212 can be welded to the first fastener member 278A, e.g., a shoulder on the valve body 214. A plastic sleeve 282 is fitted around the fuel injector 210 to overlie the junction between the two subassemblies. The retainer 230 is then installed, e.g., by snap engagement or other known fastening techniques, on the fuel tube 226.

Fuel that is to be injected from the fuel injector 210 is communicated from the fuel rail (not shown), through the fuel tube 226, the adjusting tube 280, the spring 236, the armature through-bore 246, the fuel passage(s) 248, and the fuel passage openings in the guide disk 258. Fuel is then communicated between the valve ball 234 and the seating surface 222, and exits from the fuel outlet 224.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What we claim is:

1. A fuel injector for use with an internal combustion engine, the fuel injector comprising:

a valve group subassembly including:

a valve body extending along a longitudinal axis, the valve body being connected to a non-magnetic sleeve;

a valve seat secured to the valve body, the valve seat defining an outlet opening through which fuel flows;

an armature movable along the longitudinal axis with respect to the valve body; and a valve ball coupled to the armature, the valve ball being moved between an open position wherein the valve ball is spaced from the valve seat such that fuel flow through the outlet opening is permitted and a closed position wherein the valve ball contiguously engages the valve seat such that fuel flow is prevented;

a first fastening surface; and a coil group subassembly including:

a solenoid coil operable to displace the armature with respect to the valve; and a housing generally surrounding the solenoid coil and matingly engaging the valve body of the valve group subassembly; and a second fastening surface fixed in contiguous engagement with the first fastening surface so that the valve group subassembly is secured to the coil group subassembly.

2. The fuel injector according to claim 1 wherein the valve group subassembly further includes:

a fuel tube extending along the longitudinal axis from an upstream end to a downstream end proximate to the valve body;

an adjusting tube disposed within the fuel tube; and a spring applying a biasing force urging the valve ball toward the closed position, the spring extending between the adjusting tube and the armature.

3. The fuel injector according to claim 2, wherein the valve group subassembly includes the fuel tube connecting to the non-magnetic sleeve.

4. The fuel injector according to claim 1, wherein the coil group subassembly further includes:

a bobbin defining a winding form for the solenoid coil; and an overmold generally encasing the housing.

5. The fuel injector according to claim 4, wherein a portion of the housing projecting beyond the over-mold and connecting to a shoulder on the valve body, and the housing portion is welded to the valve body shoulder.

6. The fuel injector according to claim 1, wherein the armature includes an upstream portion receiving fuel, a downstream portion including a fixture securing the valve ball, and an intermediate portion between the upstream and downstream portions.

7. The fuel injector according to claim 6, wherein the intermediate portion includes a bore extending along the longitudinal axis and a passage extending from the bore to an exterior surface of the armature.

8. The fuel injector according to claim 6, wherein the intermediate portion includes a tubular cylinder and the downstream portion includes an open end of the tubular cylinder.

9. The fuel injector according to claim 6, wherein the downstream portion includes a conical depression.

10. The fuel injector according to claim 6, wherein the valve ball is a sphere selected from a group consisting of a ball bearing and a gage ball.

11. The fuel injector according to claim 5, wherein the over-mold includes a first connector housing partially surrounding at least one electrical connector.

12. A method of assembling a fuel injector for use with an internal combustion engine, the method comprising:

assembling a valve group subassembly including a fuel tube and a non-magnetic sleeve extending along a longitudinal axis, the valve group subassembly further including a valve body having an armature, a ball valve fixed to the armature and a valve seat aligned with the longitudinal axis and a first fastening surface;

assembling a coil group subassembly including a housing generally surrounding a solenoid coil, the coil group subassembly further including an overmold generally encasing the housing and a second fastening surface;

relatively pressing the valve group and the coil group subassemblies along the longitudinal axis such that the fuel tube extends inside the overmold; and matingly engaging the first fastening surface of the valve group subassembly and the second fastening surface of the coil group subassembly so that the valve group subassembly is secured to the coil group subassembly.

13. The method according to claim 12, wherein the assembling the valve group subassembly further includes providing a closure member and an armature with an upstream portion, a downstream portion, and an intermediate portion between the upstream and downstream portions, and aligning the closure member and the downstream portion along the longitudinal axis.

14. The method according to claim 13, wherein the assembling the valve group subassembly further includes forming a depression in the valve seat and centering the closure member with the depression relative to the longitudinal axis.

15. The method according to claim 13, wherein the assembling the valve group subassembly further includes fixing the closure member to the armature and the fixing the closure member to the armature includes welding a valve ball to the armature.

16. The method according to claim 12, wherein the assembling the valve group subassembly includes fixing a closure member to an armature.

17. A solenoid actuated fuel injector for use with an internal combustion engine, the fuel injector comprising a valve group and a power group, the valve group including: a hydraulic metering subassembly having an elongated inlet tube for conveying fuel from a fuel inlet to a fuel outlet, a non-magnetic sleeve connected to an end of said inlet tube and connected to a valve body assembly having a valve body, an armature and a valve ball coupled to a portion of the armature and movable between valve closed and open positions, the valve group being calibrated independent of said power group, and wherein said inlet tube, non-magnetic sleeve and valve body are hermetically joined together to form said hydraulic metering subassembly.

18. A fuel injector for use with an internal combustion engine, the fuel injector comprising:

a valve group subassembly being insertable with a coil group subassembly; the valve group subassembly including:

a valve body extending along a longitudinal axis, the valve body being connected to a non-magnetic sleeve;

a valve seat secured to the valve body, the valve seat defining an outlet opening through which fuel flows;

an armature movable along the longitudinal axis with respect to the valve body; and a valve ball fixed to the armature, the valve ball being moved between an open position wherein the valve ball is spaced from the valve seat such that fuel flow through the outlet opening is permitted and a closed position wherein the valve ball contiguously engages the valve seat such that fuel flow is prevented;

a first fastening surface; and a coil group subassembly including:

a solenoid coil operable to displace the armature with respect to the valve body;

a housing generally surrounding the solenoid coil and matingly engaged to the valve body of the valve group subassembly; and a second fastening surface fixed in contiguous engagement with the first fastening surface so that the valve group subassembly is secured to the coil group subassembly.

19. The fuel injector according to claim 18, wherein the mating engagement between the first and second fastening features includes welding to retain the valve group subassembly with respect to the coil group subassembly.

20. The fuel injector according to claim 18, wherein the valve group comprises a valve ball fixed to the armature.

21. The fuel injector according to claim 18, wherein the coil group subassembly further includes:

a bobbin defining a winding form for the solenoid coil; and an over-mold generally encasing the housing.

22. The fuel injector according to claim 18, wherein the valve group subassembly further includes:

a fuel tube extending along the longitudinal axis from an upstream end to a downstream end proximate to the valve body;

an adjusting tube disposed within the fuel tube; and a spring applying a biasing force urging the valve ball toward the closed position, the spring extending between the adjusting tube and the armature.

23. The fuel injector according to claim 22, wherein the valve group subassembly further includes the fuel tube connecting to the non-magnetic sleeve.

24. The fuel injector according to claim 23, wherein the valve group subassembly further includes:

a first hermetic joint connecting the non-magnetic sleeve to the fuel tube; and a second hermetic joint connecting the non-magnetic sleeve to the valve body.

25. The fuel injector according to claim 24, wherein the first and second hermetic joints include welds.

26. The fuel injector according to claim 18, wherein the armature includes an upstream portion receiving fuel, a downstream portion including a fixture securing the valve ball, and an intermediate portion between the upstream and downstream portions.

27. The fuel injector according to claim 26, wherein the intermediate portion includes a bore extending along the longitudinal axis and a passage extending from the bore to an exterior surface of the armature.

28. The fuel injector according to claim 26, wherein the intermediate portion includes a tubular cylinder and the downstream portion includes an open end of the tubular cylinder.

29. The fuel injector according to claim 26, wherein the downstream portion includes a conical depression.

30. The fuel injector according to claim 26, wherein the valve ball is a sphere selected from a group consisting of a ball bearing and a gage ball.

31. The fuel injector according to claim 26, wherein the valve ball is welded to the downstream portion.

32. The fuel injector according to claim 23, wherein the over-mold includes a first connector housing partially surrounding at least one electrical connector, the first connector housing being adapted for electrical communication.

33. The fuel injector according to claim 22, wherein a portion of the housing projecting beyond the over-mold and connecting to a shoulder on the valve body, and the housing portion is welded to the valve body shoulder.

* * * * *